US006004234A

United States Patent [19]

Majchrowicz

[11] Patent Number: 6,004,234

[45] Date of Patent: Dec. 21, 1999

[54] ARTICULATED HANDLE FOR HOCKEY STICKS AND THE LIKE

[76] Inventor: Michael Majchrowicz, 12335 W Prince of Peace, Eagle River, Ak. 88577

[21] Appl. No.: 09/132,933

[22] Filed: Aug. 11, 1998

[51] Int. Cl.[6] ..... A63B 59/12

[52] U.S. Cl. ..... 473/560

[58] Field of Search ..... 473/299, 551, 473/560, 568, FOR 189

[56] References Cited

U.S. PATENT DOCUMENTS

| | | | |
|---|---|---|---|
| 3,410,016 | 11/1968 | Arsenault | 473/299 |
| 4,038,719 | 8/1977 | Bennett | 473/551 |
| 4,553,753 | 11/1985 | Gibbons | 473/560 |
| 5,163,685 | 11/1992 | Rhodes | 473/551 |
| 5,257,782 | 11/1993 | Schicketanz | 473/551 |
| 5,322,286 | 6/1994 | Frost | 473/568 |

FOREIGN PATENT DOCUMENTS

| | | | |
|---|---|---|---|
| 1159485 | 12/1983 | Canada | 473/FOR 189 |
| 1167876 | 5/1984 | Canada | 473/FOR 189 |

*Primary Examiner*—Mark S. Graham
*Attorney, Agent, or Firm*—Michael Tavella

[57] ABSTRACT

An articulated handle for hockey sticks. This articulated handle extends downwards and outwards from the top of the stick handle. The articulated handle is compound angled and forms a grip for the user. In use, the player holds the stick in one hand at about the center of the handle as before. The upper hand holds the articulated handle. The articulation creates a natural position for holding the stick. Moreover, it gives the user considerably more power and control. Finally, the articulated handle reduces the stress placed on the user's wrist, thereby reducing or eliminating stress injuries. Although this handle is designed for use with hockey sticks, it can also be used on any handled implement, such as shovels, rakes, hoes, tennis rackets, or other similar implements.

5 Claims, 4 Drawing Sheets

ARTICULATED HANDLE FOR HOCKEY STICKS AND THE LIKE

CROSS REFERENCE TO RELATED APPLICATIONS

Not Applicable.

STATEMENT REGARDING FEDERALLY SPONSORED RESEARCH AND DEVELOPMENT

Not Applicable.

BACKGROUND OF THE INVENTION

1. Field of the Invention

This invention relates to handles for hockey sticks and other handled implements, and particularly to articulated handles for hockey sticks and other handled implements.

2. Description of Related Art

Hockey is a sport that uses a long handled stick to move a puck across an ice rink. The sticks have a blade end and a long handle that extends upward from the blade at an angle. Typically, the stick is gripped with the hands. One hand holds the handle at about the center of the handle. The other hand holds the handle near the top. Because of the angle of the blade and handle, the upper hand often holds the handle at an awkward angle. This not only decreases power and agility in stick handling, it can lead to stress injuries for players.

BRIEF SUMMARY OF THE INVENTION

To address this problem, I have designed an articulated end for hockey sticks. This articulated end extends downwards and outwards from the top of the stick handle. The articulated handle is compound angled and forms a grip for the user. In use, the player holds the stick in one hand at about the center of the handle as before. The upper hand holds the articulated handle. The articulation provides a natural position for holding the stick. Moreover, it gives the user considerably more power and control. Finally, the articulated handle reduces the stress placed on the user's wrist, thereby reducing or eliminating stress injuries.

Although this handle is designed for use with hockey sticks, it can also be used on any handled implement, such as shovels, rakes, hoes, tennis rackets, etc.

DETAILED DESCRIPTION OF THE INVENTION

Figure 2:
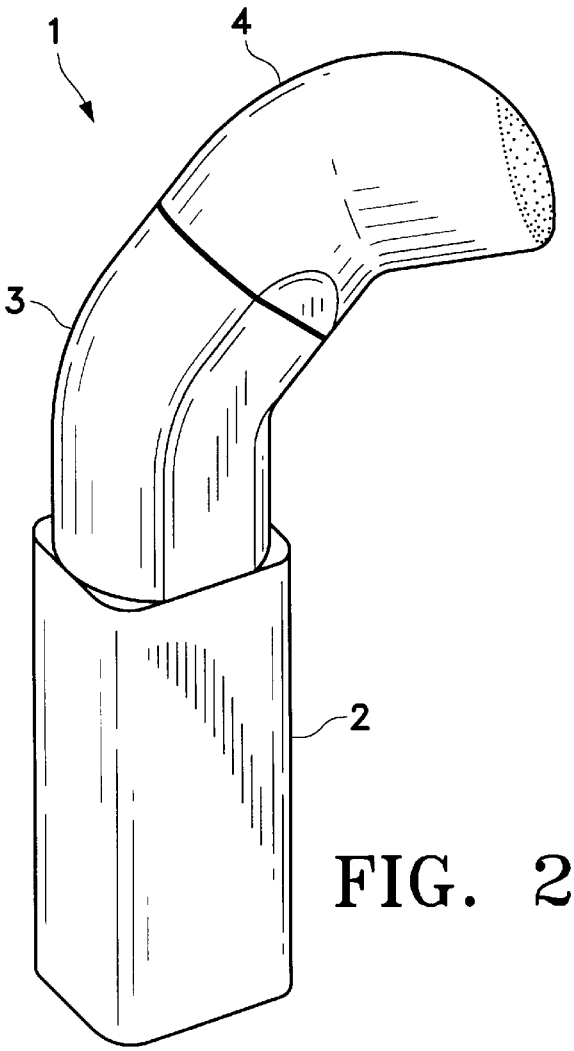
FIG. 2 is a detail view of the handle end
Figure 1:
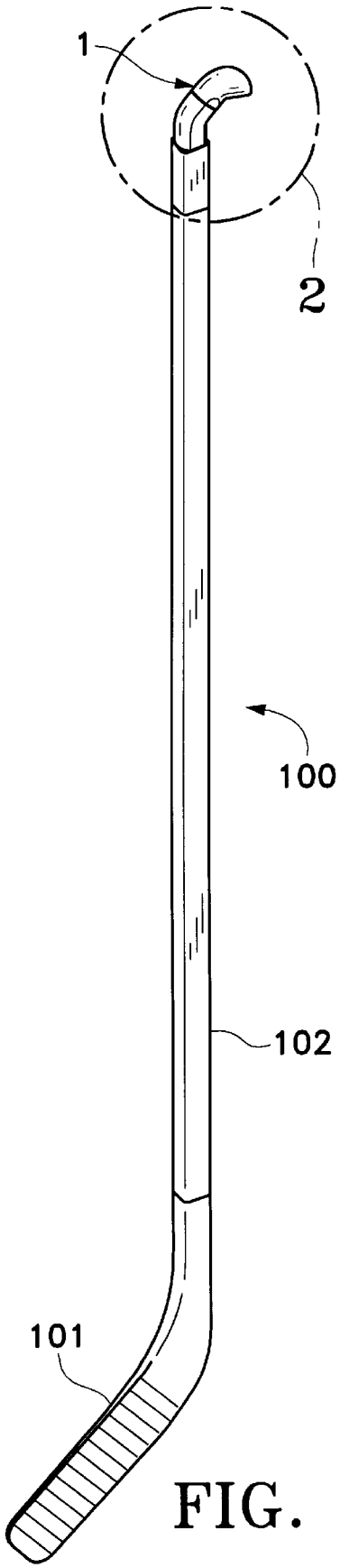
FIG. 1 is a perspective view of a hockey stick showing my new handle end.
Figure 3:
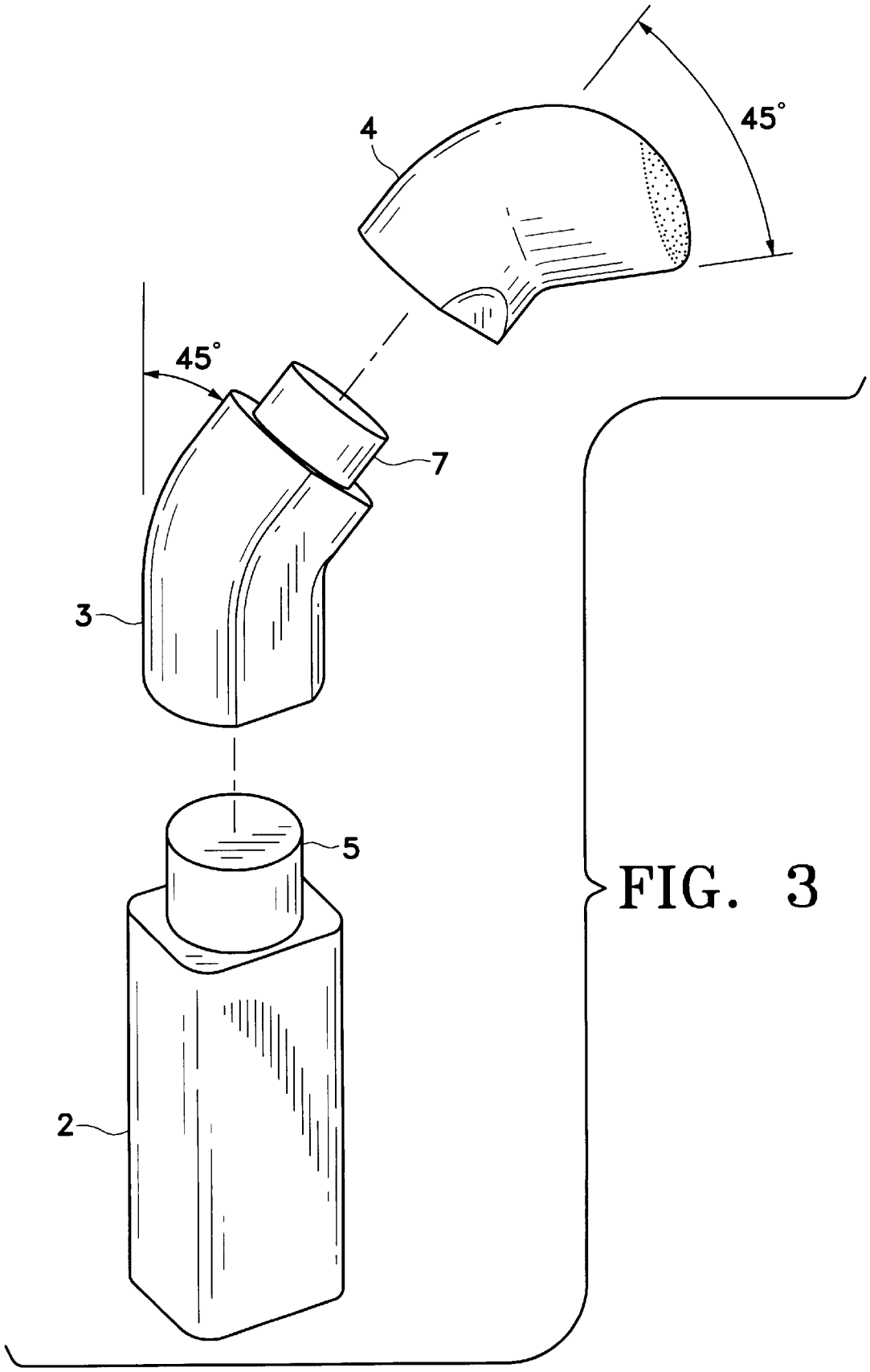
FIG. 3 is an exploded view of the handle end showing the basic components and their angular relationships for a right-handed hockey stick.

Referring now to FIG. 1, A typical hockey stick 100 is shown with the new invention 1 in place. The stick has a blade 101 and an elongated shaft 102. Normally, the upper end of the stick 100 is squared off and capped with tape or a rubber cap. Here, the normal cap is removed and my angled handle 1 is fitted into the hockey stick 100 as shown. FIG. 2 is a detail of the handle 1. It has a lower squared unit 2, a center bending unit 3 and a top piece 4 as shown. FIG. 3 shows these components in an exploded view for a right-handed hockey stick. The lower unit 2 is designed to fit into the top of the stick shaft 102. At the top of the lower unit 2 is a pin or tenon 5. This pin is designed to fit into a corresponding hole (not shown) in the center unit 3 The center unit 3 is angled at a 45 degree angle from vertical. At the top of the center unit 3 is a second pin 7. This pin 7 is designed to fit into a hole (not shown) in the bottom of the top piece 4. The top piece 4 also has a 45 degree bend formed in it as shown. The end 4 is rounded as shown.

Figure 4:
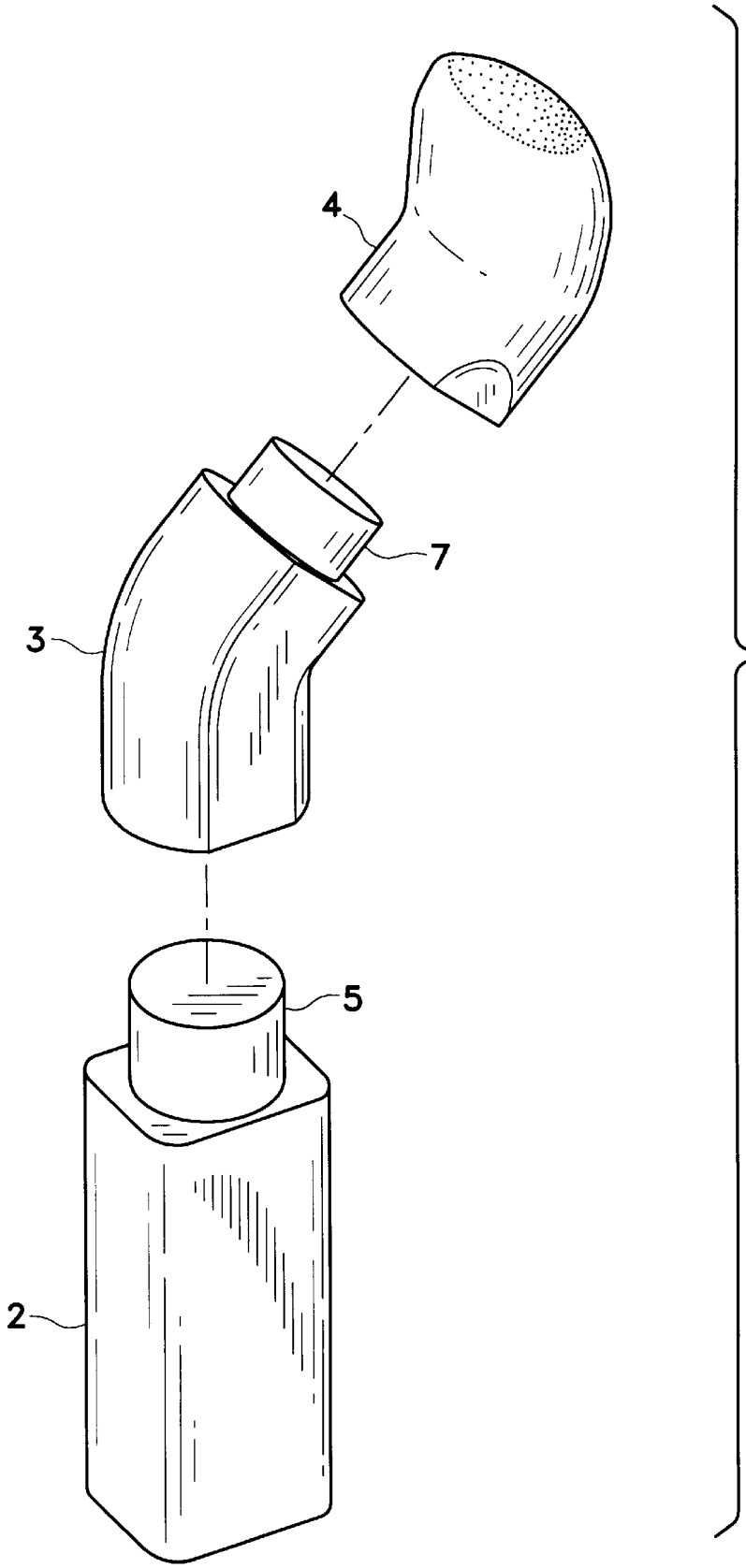
FIG. 4 is an exploded view of the handle end showing the basic components and their angular relationships for a left-handed hockey stick.
Figure 5:
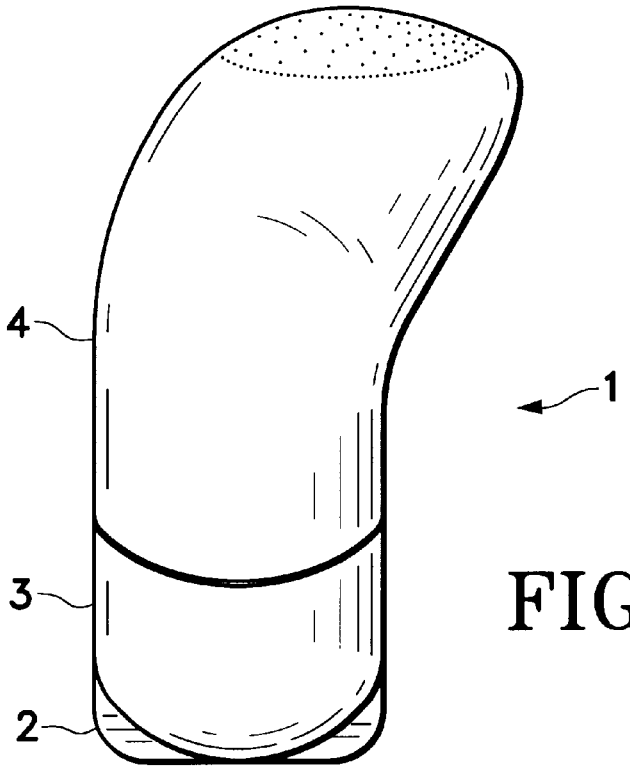
FIG. 5 is a top plan view of the right-handed handle.
Figure 6:
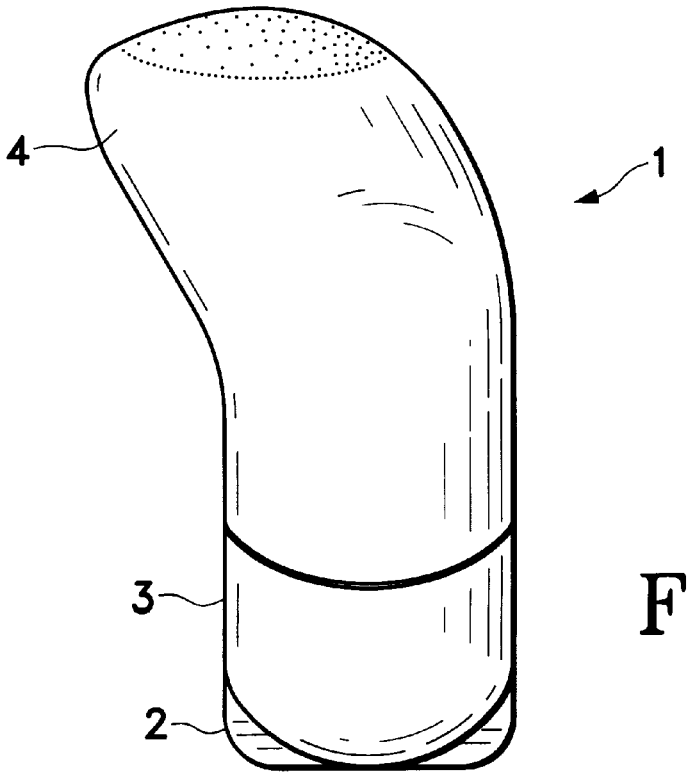
FIG. 6 is a top plan view of the left-handed handle.

FIG. 4 shows an exploded view of the left-handed handle. This design is identical to that of FIG. 3 except that the top piece 4 is turned to accommodate a left-handed player. This angular difference is clearly shown in the two top views of FIGS. 5 and 6.

A player holds the stick with one hand along the shaft 102. The player's other hand grips the handle 1. Because of the angles of the handle 1, the player holds the handle normal to the shaft 102. As a result, the player does not have to bend the upper hand to hold the stick. In this way, the player can grip the stick more comfortably, produce more power in shooting and avoid potentially serious injuries caused by having to bend the wrist to hold the stick.

The device can be made of separate parts, as shown in FIG. 3, for example. In the preferred embodiment, the device is made in one piece and is molded to shape. The preferred material is a lightweight plastic, or similar material.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An articulated handle for a hockey stick, comprising:

a) a lower alignment unit, configured to conform to a shaft of a hockey stick;

b) a first articulated unit, attached to said lower alignment unit and extending away therefrom at a first angle with respect to a line extending along a tangent from the lower alignment unit; and c) a second articulated unit, attached to said first articulated unit and extending away therefrom at a second angle with respect to the first angle, wherein the second angle is about forty-five degrees.

2. The articulated handle of claim 1 wherein the lower alignment unit, the first articulated unit and the second articulated unit are formed in one piece.

3. The articulated handle of claim 1 wherein the first angle is about forty-five degrees.

4. The articulated handle of claim 1 wherein the combination of said first articulated unit and second articulated unit is aligned in a right-handed orientation.

5. The articulated handle of claim 1 wherein the combination of said first articulated unit and second articulated unit is aligned in a left-handed orientation.

* * * * *